United States Patent [19]

Haley

[11] 4,161,199

[45] Jul. 17, 1979

[54] VAPOR RECOVERY FRAME

[75] Inventor: Frank P. Haley, Upland, Calif.

[73] Assignee: FMC Corporation, San Jose, Calif.

[21] Appl. No.: 819,740

[22] Filed: Jul. 28, 1977

[51] Int. Cl.[2] ..... B65B 3/18

[52] U.S. Cl. ..... 141/387; 137/615

[58] Field of Search ..... 61/86; 114/74 R; 137/236, 255, 262, 266, 615; 214/13, 14; 141/99, 104, 231, 232, 237, 242, 279, 284, 290, 325, 326, 387, 388, 392

[56] References Cited

U.S. PATENT DOCUMENTS

| | | | |
|---|---|---|---|
| 3,249,121 | 5/1966 | Bily | 141/388 X |
| 3,311,142 | 3/1967 | Bergstrom | 141/388 |
| 3,664,386 | 5/1972 | Wenzel | 141/387 X |
| 3,799,217 | 3/1974 | Bauer | 141/387 X |
| 3,926,135 | 12/1975 | DeGragario | 114/74 R |

*Primary Examiner*—Richard E. Aegerter

*Assistant Examiner*—Frederick R. Schmidt

*Attorney, Agent, or Firm*—Lloyd B. Guernsey; W. William Ritt, Jr.

[57] ABSTRACT

A vapor recovery system especially useful for collecting the evolved vapors from crude oil or other volatile liquids being transferred between floating tankers and a storage container. A generally U-shaped frame is pivotably mounted to a support at each end of the frame. The frame carries a pair of conduit members having a plurality of openings distributed along the length thereof. Flexible hoses are connected between each of the openings in the conduit members and a corresponding vent in the tankers. A winch and cable arrangement is used to lower the frame into operating position and to raise the frame into a stowed position at the end of a loading period. The ends of the conduit members are each connected to a vapor storage container through a swivel joint.

6 Claims, 6 Drawing Figures

VAPOR RECOVERY FRAME

BACKGROUND OF THE INVENTION

1. Field of the Invention

This invention relates to vapor recovery apparatus and, more particularly, to apparatus for collecting and storing vapors which evolve as volatile fluids are transferred between transporting vehicles and a storage facility.

2. Description of the Prior Art

The transfer of large quantities of crude oil and other hydrocarbon products between oil tankers and shore facilities is invariably accompanied by the generation of large volumes of vapor. At the present time these vapors are not recovered but are vented into the atmosphere where they may form explosive pockets, thereby creating a fire and safety hazard. In addition, the loss of vapors causes shrinkage of the hydrocarbon product being transferred, which of course is expensive. These vapors also contaminate the air and contribute to the generation of "smog". Up to the present time there has been no known apparatus which is available to overcome this problem of air contamination by a large tanker being loaded or unloaded.

Vapor recovery-type fluid delivery arms have been designed for use in loading gasoline tank trucks and include a delivery head assembly with provision both for discharging gasoline into the truck and for returning gasoline vapors to storage. Some examples of the prior art delivery arms are described in the United States Pats. Nos. 3,099,297 issued July 1963 to Knight, 3,176,730 issued April 1965 to Knight, and 3,825,045 issued July 1974 to Bloomquist.

These prior art recovery-type fluid delivery arms are small and are not usable for loading or unloading large tankers as they cannot handle large quantities of fluid which must be rapidly pumped into or out of the large floating tankers. If these prior art delivery arms were increased to size needed to quickly load or unload the floating tankers the arms would be too heavy and too difficult to handle. Also, the floating tankers move up, down and sideways relative to the loading dock, so the arms would need to be redesigned to accommodate the relative movement between the tanker and the dock.

SUMMARY OF THE INVENTION

This invention provides apparatus for recovering vapor from volatile fluids such as crude oil as it is being transferred between floating tankers having a plurality of vapor ducts and a shore facility. The vapor recovery apparatus is separated from the fluid loading arm which is used to transfer the fluid between the tanker and the shore installation.

The vapor recovery apparatus of the subject invention has a conduit member having a plurality of openings spaced along the length of the conduit member. The conduit member is supported by a frame member. Means are provided for connecting each of the openings in the openings in the conduit member to a corresponding one of the plurality of vapor sources and means are provided for coupling said conduit member to a central recovery location.

DESCRIPTION OF THE PREFERRED EMBODIMENT

Figure 1:
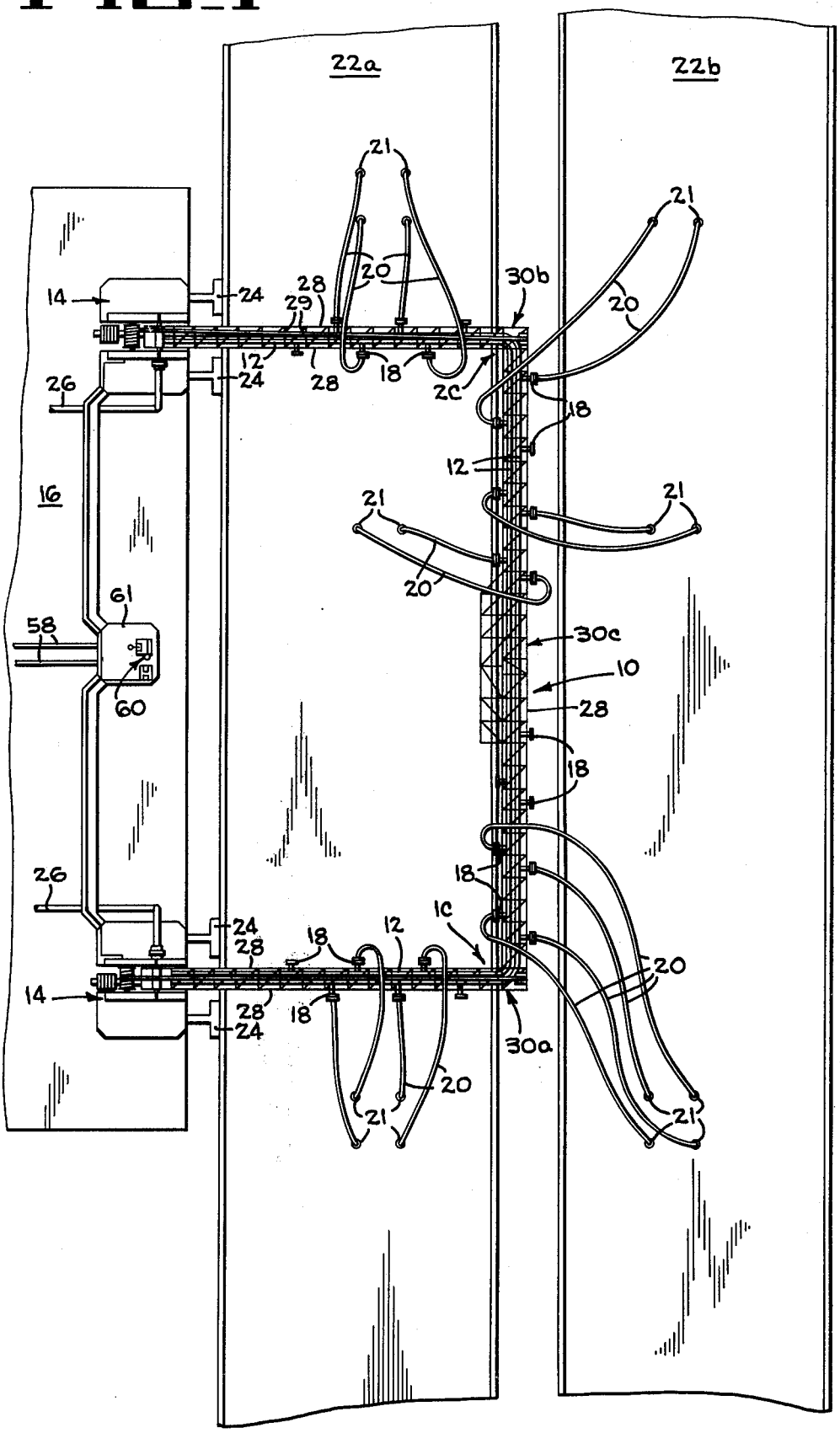
FIG. 1 is a plan view of a vapor recovery apparatus of the present invention in position for unloading a pair of tankers secured to a loading dock.
Figure 2:
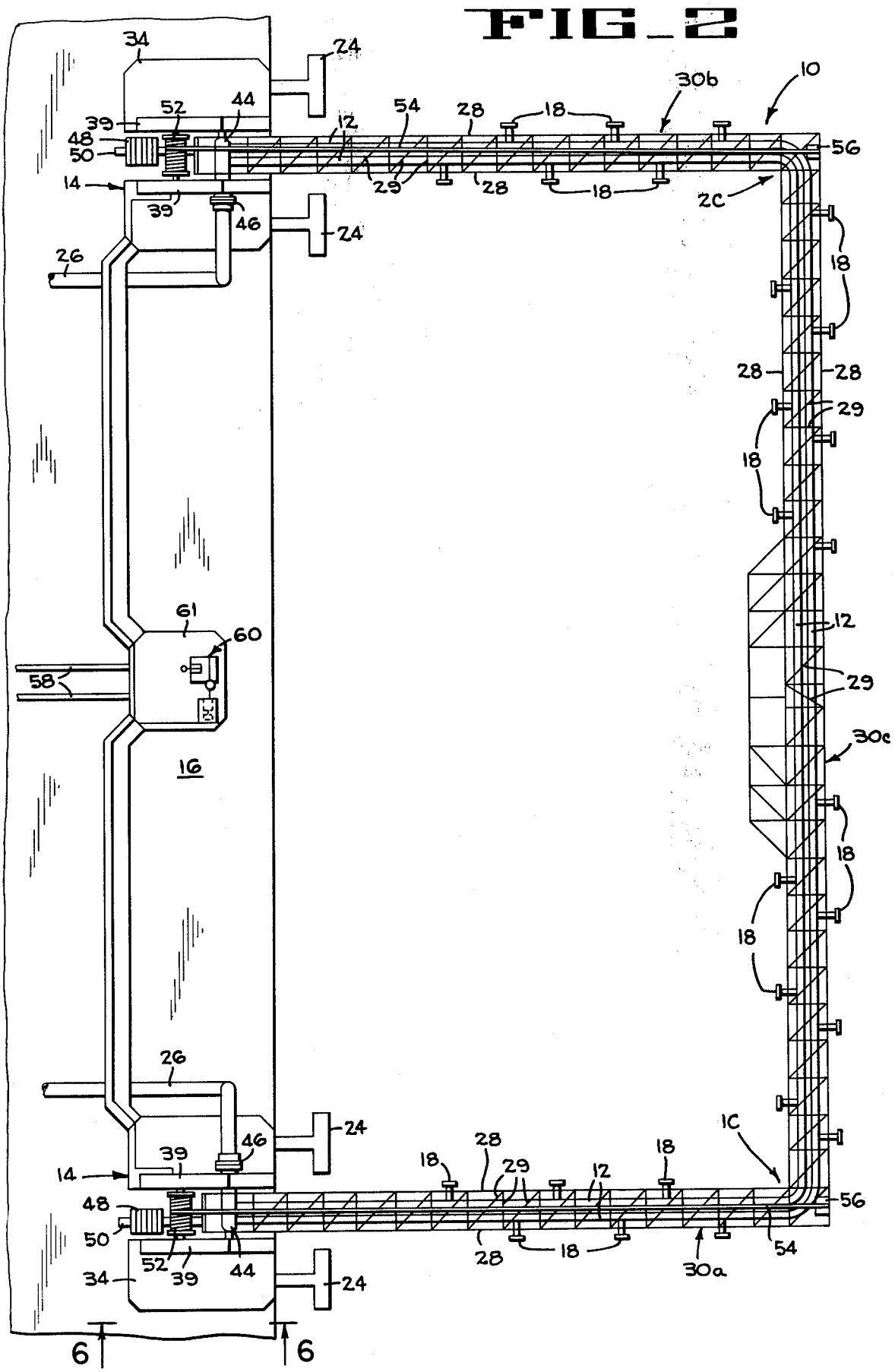
FIG. 2 is an enlarged plan view of the apparatus of FIG. 1 illustrating details of the apparatus.
Figure 4:
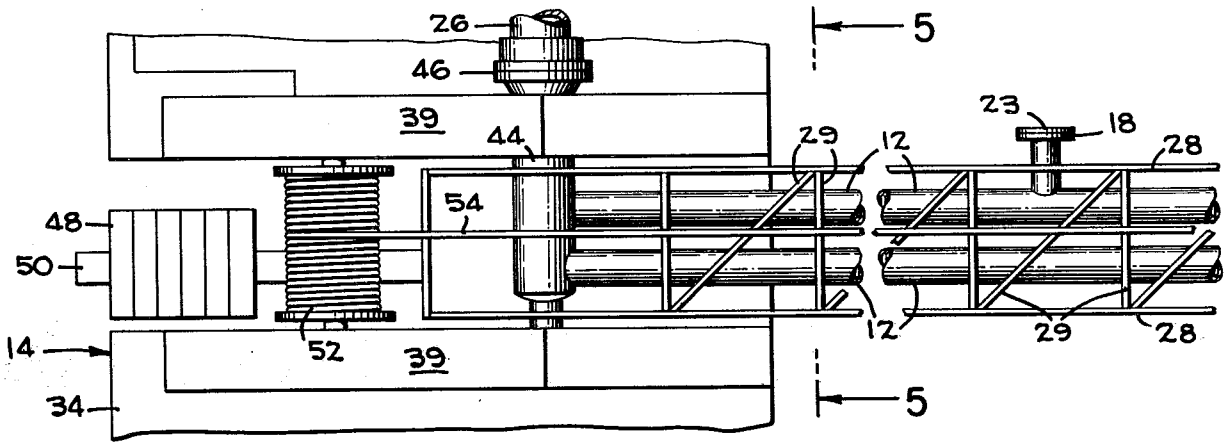
FIG. 4 is an enlarged fragmentary plan view of a portion fragment of the apparatus of FIG. 2.
Figure 3:
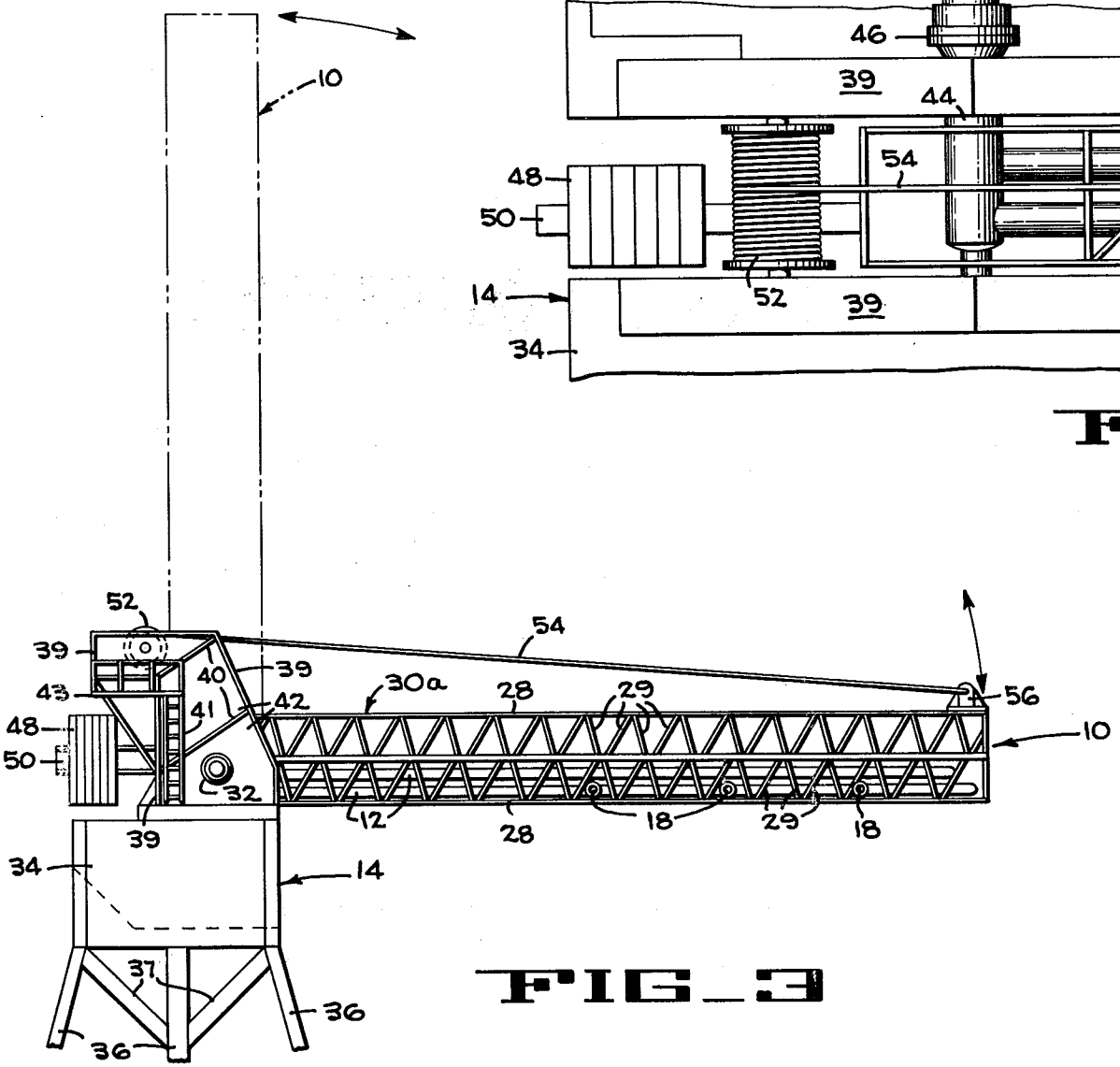
FIG. 3 is a side elevation of the apparatus illustrated in FIG. 2.

The vapor recovery apparatus illustrated in FIGS. 1-3 includes a generally U-shaped support frame 10 having a pair of vapor conveying ducts 12 mounted therein. The ends of the frame 10 are pivotally connected to a pair of support towers 14 which are mounted on a loading dock 16. Each of the vapor conveying ducts has a plurality of openings 18 which may be connected to a corresponding one of a plurality of flexible hoses 20 which in turn are each connected to one of the vapor ducts or hatches 21 of a pair of crude oil tankers or barges **22*a* and 22*b*. Any of the openings which are not connected to a hose are covered by a cap 23 (FIG. 4). The tankers are secured in fluid transfer position adjacent the dock (FIG. 1) by the usual mooring lines (not shown) and are protected from damage due to moving into the dock by a plurality of dock fenders 24. Vapors from the holds of the tankers flow from the vapor hatches 21 through the hoses 20 and the ducts 12 to a pair of feeder conduits 26 which carry the vapors to a vapor recovery tank (not shown). When the vapor recovery apparatus is not in use the support frame 10 is stowed in the position illustrated in the phantom lines of FIG. 3. When one or more tankers 22 are moved into unloading position the frame 10 is moved into the position shown in FIG. 1 and the hoses 20 are connected to the vapor hatches 21** of the tankers.

Figure 5:
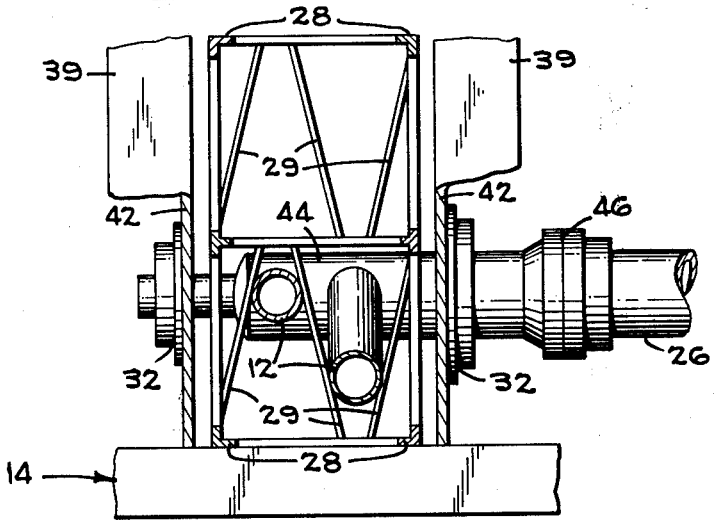
FIG. 5 is a section taken along lines 5—5 of FIG. 4.
Figure 6:
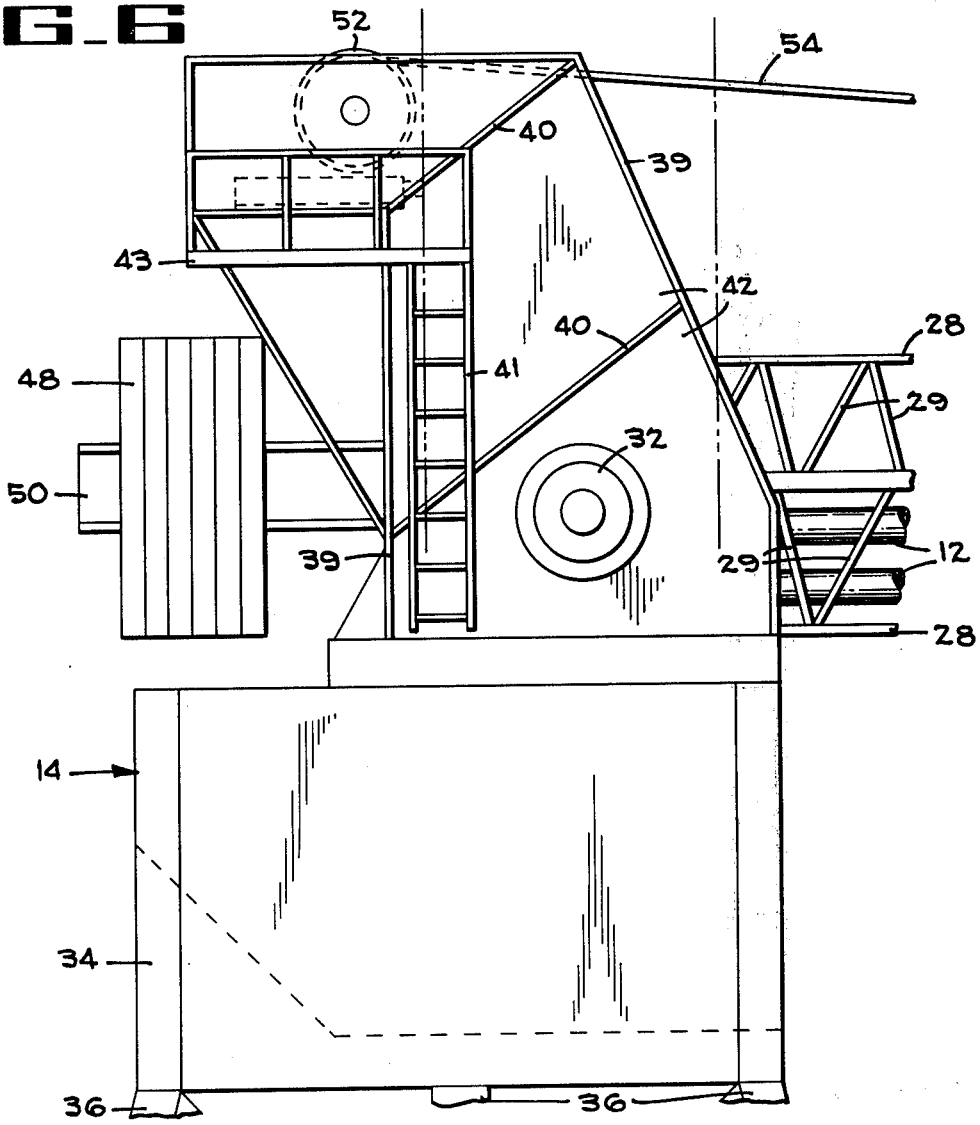
FIG. 6 is an enlarged side elevation taken in the direction of lines 6—6 of FIG. 2.

The support frame 10 (FIG. 1) includes a pair of side sections **30*a* and 30*b* and an end or central section 30*c*. Each of these sections 30*a*-30*c* is comprised of four elongated metal rods 28 (FIGS. 3 and 4) interconnected by a plurality of cross members 29 which are welded or otherwise connected between the elongated rods 28 to provide strength and rigidity to the frame. When longer rods are needed, several short rods may be welded together in an end-to-end arrangement to form each of the elongated rods 28. The distal end of each of the side sections 30*a* and 30*b* is welded or otherwise attached to one of the ends of the central section 30*c* at one of the outside corners 1C and 2C (FIG. 2). The proximal end of each of the side sections is connected to one of the support towers 14 by a pair of swivel joints 32 (FIG. 4-6**).

Each of the support towers 14 (FIGS. 2,3 and 6) includes a box like structure 34 supported by a plurality of legs 36 which are interconnected by a plurality of cross members 37. The lower end of the legs 36 are bolted or otherwise secured to the dock 16. The upper portion of the tower 14 includes a plurality of rigid frame members 39 (FIG. 6) interconnected by one or more cross members 40 and secured to the structure 34. A plurality of metal panels 42 (FIGS. 5 and 6) connected to the frame members 39 and to the cross members 40 provide strength and rigidity for the upper portion of the tower. A ladder 41 and a catwalk 43 are mounted on the side of the tower to provide access to the upper portion of the tower for maintenance and repair.

A header pipe 44 (FIGS. 4,5) is pivotally mounted to the metal panels 42 by the pair of swivel joints 32. The header pipe 44 is welded to the frame 10 and to the ducting 12 so that the header pipe 44 and the swivel joints 32 provide support for the support frame 10 and for the ducting 12. The header pipe 44 conveys the vapors from the ducting 12, through a swivel joint 46 (FIG. 5) to the feeder ducting 26 which carries the vapors to central recovery tanks (not shown). These recovery tanks and associated recovery devices are provided by the customer who receives the fluid being unloaded from the tanker 22 and such recovery devices are not considered to be critical to this invention.

The apparatus of the present invention includes a counter-balancing system designed to neutralize a majority of the weight of the support frame 10 and the ducting 12. The system includes a pair of counterweights 48 each mounted on a corresponding one of the rods 50 which extends rearwardly from the proximal end of the support frame 10 (FIGS. 2–4). The counterweights 48 provide a downward force which counterbalances most of the turning movement induced by gravity on the support frame 10 and the ducting 12. The turning moment which is not balanced by the counterweights tends to move the supporting frame and ducting into the working position shown in the solid lines of FIG. 3. A winch and cable arrangement is provided for moving the frame and ducting from the working position into the stowed position shown in the phantom lines of FIG. 3.

A hydraulic winch 52 is mounted on the upper portion of each of the towers 14 to provide power for pivotal movement of the frame 10 into the stowed position. A cable 54 is connected between each of the winches 52 and an ear 56 which is mounted on the supporting frame 10 at a corresponding one of the outside corners 1C and 2C (FIG. 2). The winches are a standard type of hydraulic winch which is available from several sources. The size of the winch to be used in determined by the dimensions of the sections 30*a–30c* of the frame 10, and the dimensions of the sections 30*a–30c* are determined by the size of the tankers which can be loaded and unloaded at the loading dock 16. Suitable hydraulic lines 58 (FIG. 2), connected to a source of hydraulic power (not shown), provide fluid pressure to rotate the winches (FIGS. 2,3 and 6) to thereby raise or lower the support frame. A set of control valves 60 (FIG. 2) located in a control room 61 cause the winch 52 (FIGS. 3 and 6) to rotate counterclockwise to raise the frame 10 toward the stowed position when the valve 60 is moved in one direction, and cause the winch to rotate clockwise to allow the frame to be lowered toward the operating position when the valve is moved in the other direction. When the valve is in a central position the frame is retained in a fixed position.

Thus, the foregoing invention provides a U-shaped recovery apparatus which collects vapors from a plurality of vapor ducts on a one or more floating tankers and directs the vapors to central recovery tanks where the vapors are stored. Lightweight ducting and a lightweight support frame are used so that the apparatus can be pivotally supported at the ends of the frame. The lightweight unit can be easily lowered into working position and raised into a stowed position when not in use. Flexible hoses from the ducting to the floating tankers allow for movement of the tankers during the unloading operation. The present invention can also be use to transfer low-pressure, high-volume liquid from one source location to several storage locations or from several source locations to a single storage location.

Although the best mode contemplated for carrying out the present invention has been herein shown and described, it will be apparent that modification and variation may be made without departing from what is regarded to be the subject matter of the invention.

What is claimed is:

1. Apparatus for collecting vapors from a plurality of vapor ducts of a marine tanker and routing said vapors to a central recovery container, wherein said apparatus is mounted on a dock alongside a tanker mooring area, said apparatus comprising:

a generally U-shaped rigid supporting frame including spaced substantially parallel side sections and an elongated central section extending between one pair of ends of said side sections, a generally U-shaped conduit member mounted to said frame member and having a plurality of openings along the length thereof adjacent said frame side and central sections, longitudinally spaced support means for said frame and conduit member, means for pivotally connecting said support means to the other pair of ends of said U-shaped frame side sections for swinging movement thereof about a horizontal axis, means for pivotally lowering said frame about said axis to a position with said conduit openings in proximity with the vapor ducts of a moored marine tanker, means for respectively connecting each of said vapor ducts to an adjacent opening in said conduit member, means adjacent said support means for connecting said conduit member to said central recovery container, and means for pivotally raising said frame and said conduit member mounted thereon into a stored position on said dock when said apparatus is not in use.

2. Apparatus for collecting vapors from a plurality of vapor ducts as defined in claim 1, including means for capping any of said openings which are disconnected from said vapor sources.

3. Apparatus for collecting vapors from a plurality of vapor ducts as defined in claim 1 wherein said means for connecting each of said vapor ducts to one of said openings includes a flexible hose.

4. Apparatus for collecting vapors as defined in claim 1 wherein said means for raising and lowering said frame and said conduit member includes: a winch, a cable, means for mounting said winch to said support means, and means for connecting said cable between said winch and said frame member.

5. Apparatus for collecting vapors as defined in claim 1 wherein said frame member comprises: a plurality of elongated tubular members and a plurality of cross members, said cross members interconnecting said elongated tubular members.

6. Apparatus for collecting vapors as defined in claim 1 including means for counterbalancing said frame member about said support means.

* * * * *